United States Patent [19]

Alinder et al.

[11] 4,120,463

[45] Oct. 17, 1978

[54] FLOOR COVERING MEASURING AND CUTTING APPARATUS

[75] Inventors: Gilbert L. Alinder, Sun City, Ariz.; Lloyd E. Anderson, Brooklyn Park, Minn.

[73] Assignee: National Carpet Jobbers, Minneapolis, Minn.

[21] Appl. No.: 829,286

[22] Filed: Aug. 31, 1977

[51] Int. Cl.[2] ..... B65H 19/20

[52] U.S. Cl. ..... 242/56 R; 242/66; 242/67.3 R

[58] Field of Search ..... 242/56 R, 67.3 R, 67.1 R, 242/66, 78.7, 78.8

[56] References Cited

U.S. PATENT DOCUMENTS

| | | | |
|---|---|---|---|
| Re. 28,414 | 5/1975 | Keesling | 242/56 R |
| 3,386,678 | 6/1968 | Malone | 242/56 R |
| 3,917,183 | 11/1975 | Malone | 242/56 R |
| 3,931,940 | 1/1976 | Raighn | 242/56 R |
| 4,002,308 | 1/1977 | Feighery | 242/56 R |

*Primary Examiner*—Edward J. McCarthy

*Attorney, Agent, or Firm*—Schroeder, Siegfried, Ryan, Vidas & Steffey

[57] ABSTRACT

The present invention is directed to an improved floor covering measuring and cutting apparatus which includes a measuring and cutting table and an adjustable roll holding cradle. Bulk rolls on the cradle may be readily adjusted relative to the position of the cutting table and the guides thereon to assure proper feed of the floor covering material from the bulk roll through the measuring and cutting table. The measuring and cutting table includes an improved means for positioning the floor covering material on a roll up shaft to insure proper feed to the shaft and uniform wrapping of the floor covering material thereon. The adjustable bulk roll holding cradle includes improved means for loading and unloading bulk rolls thereon. The improvements facilitate operation of the apparatus by a single operator, making it readily adaptable for all sizes of floor covering material and enabling the operator to load and unload the bulk roll, reroll it after cutting and to unload the measured and cut roll.

13 Claims, 7 Drawing Figures

FLOOR COVERING MEASURING AND CUTTING APPARATUS

FIELD AND BACKGROUND OF INVENTION

This invention relates to a floor covering measuring and cutting apparatus and more particularly to an improved apparatus of this type for the handling, unrolling, rerolling, cutting and packaging of floor covering materials of varying widths in a simplified system which can be operated by a single operator.

Machines for the handling of floor covering materials, such as carpeting and linoleum are well recognized and in use. They includes structures for supporting and unwinding bulk rolls, measuring the floor covering material taken therefrom, rolling up a desired cut length and wrapping the same. Known machines of this type are generally complex in structure, requiring relatively large floor space, special machinery for handling the floor covering rolls for unloading and loading the same on the machine and a plurality of people to operate the same. Examples of such machines can be found in the patents to Keesling U.S. Pat. No. Re. 28,414 dated May 6, 1976 and entitled FABRIC CUTTING AND MEASURING MACHINE, and Lee U.S. Pat. No. 3,228,620 dated Jan. 11, 1966 and entitled YARDAGE COMBINE. Such equipment, because of its size and complexity requires a special installation, special equipment for operating the same and plurality of operators.

Our prior patent application, Ser. No. 761,639 filed Jan. 24, 1977 entitled MEASURING AND CUTTING APPARATUS FOR FLOOR COVERING is directed to a portable machine of this general type. While this meets the need for a machine capable of handling carpeting and linoleum in various sizes which is portable such that it may be moved to various locations, the problem of handling bulk rolls associated with such machinery, both in unrolling and rerolling of the same, and the difficulty in starting and guiding wide widths of floor covering material on the rollup shaft and the covering of the same for packaging creates delays in operation of the apparatus. Further, the problems of accurately feeding carpeting from a bulk roll onto a machine so that it runs true to the guides thereof makes the application of a portable machine undesirable.

SUMMARY OF PRESENT INVENTION

The present invention is directed to an improved floor covering measuring and cutting apparatus which includes a floor covering measuring and cutting machine and an adjustable cradle which may be readily adjusted relative thereto to assure proper feed of floor covering from a bulk roll through the measuring and cutting machine. Further, the improved machine includes a simplified structure on the holding cradle for ease in loading and unloading of bulk rolls thereon. The improved apparatus further includes improvements in the measuring and cutting machine in the form of suitable guide plates to assure holding of the carpet as it is started on the roll-up mandrels so that it properly rolls thereon. Such additional guides aid in the packaging of a measured and cut roll by holding the covering material as the roll is wrapped. These improvements facilitate the operation of the apparatus by a single operator and make it readily adaptable for all sizes of floor covering material. It enables the operator to load the machine with the bulk roll, to unroll and to reroll it after cutting, and unload the measured and cut roll. The improved machine includes a holding cradle which is powered to aid the unrolling and rerolling of the bulk roll and is readily adjustable with respect to the measuring and cutting table so that it may properly guide the floor covering material from the bulk roll thereon. Further, the machine provides a simplified arrangement for adjusting the machine to varying widths of floor covering material.

DESCRIPTION OF PREFERRED EMBODIMENT

Figure 1:
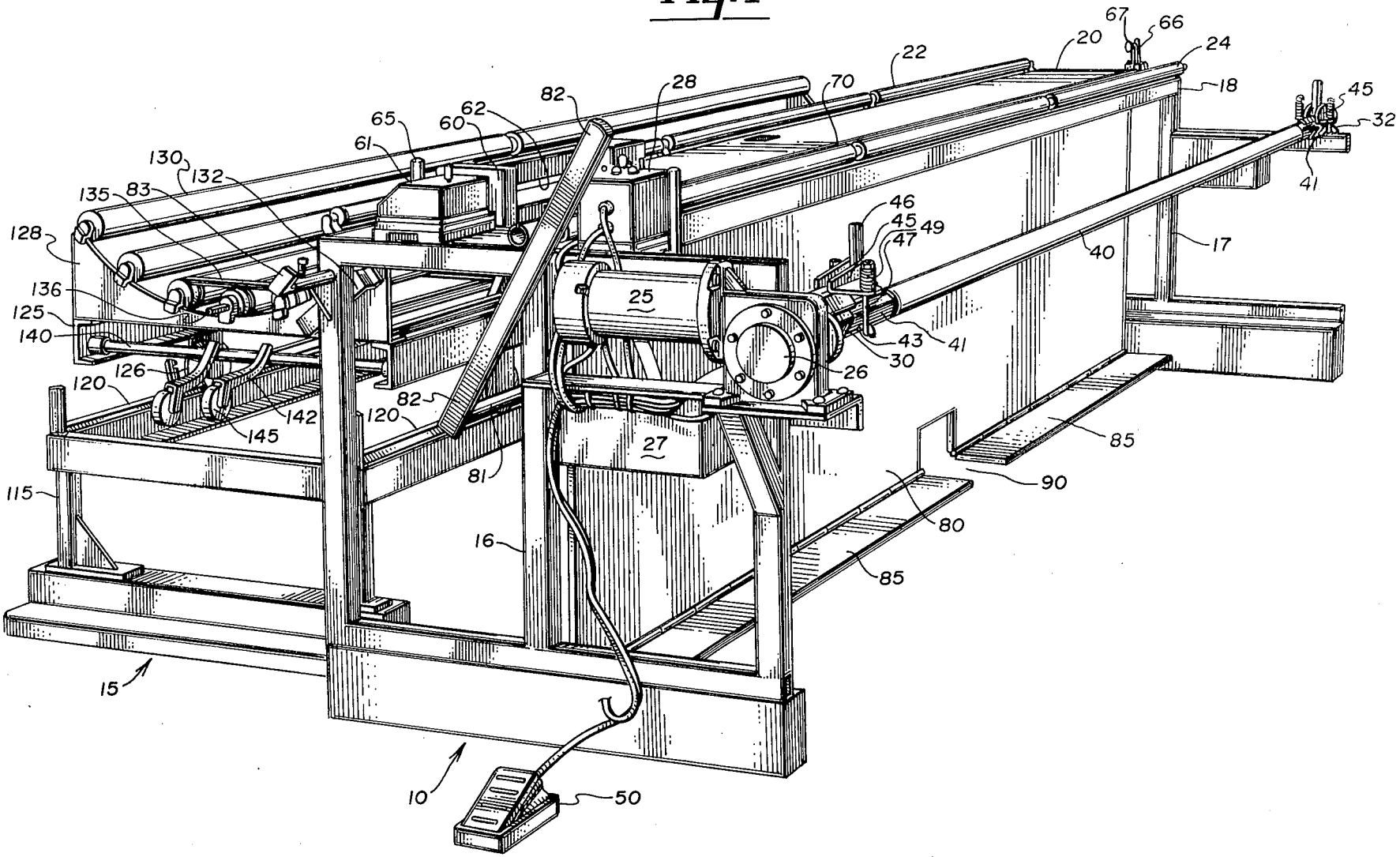
FIG. 1 is a perspective view of the floor covering measuring and cutting apparatus.
Figure 2:
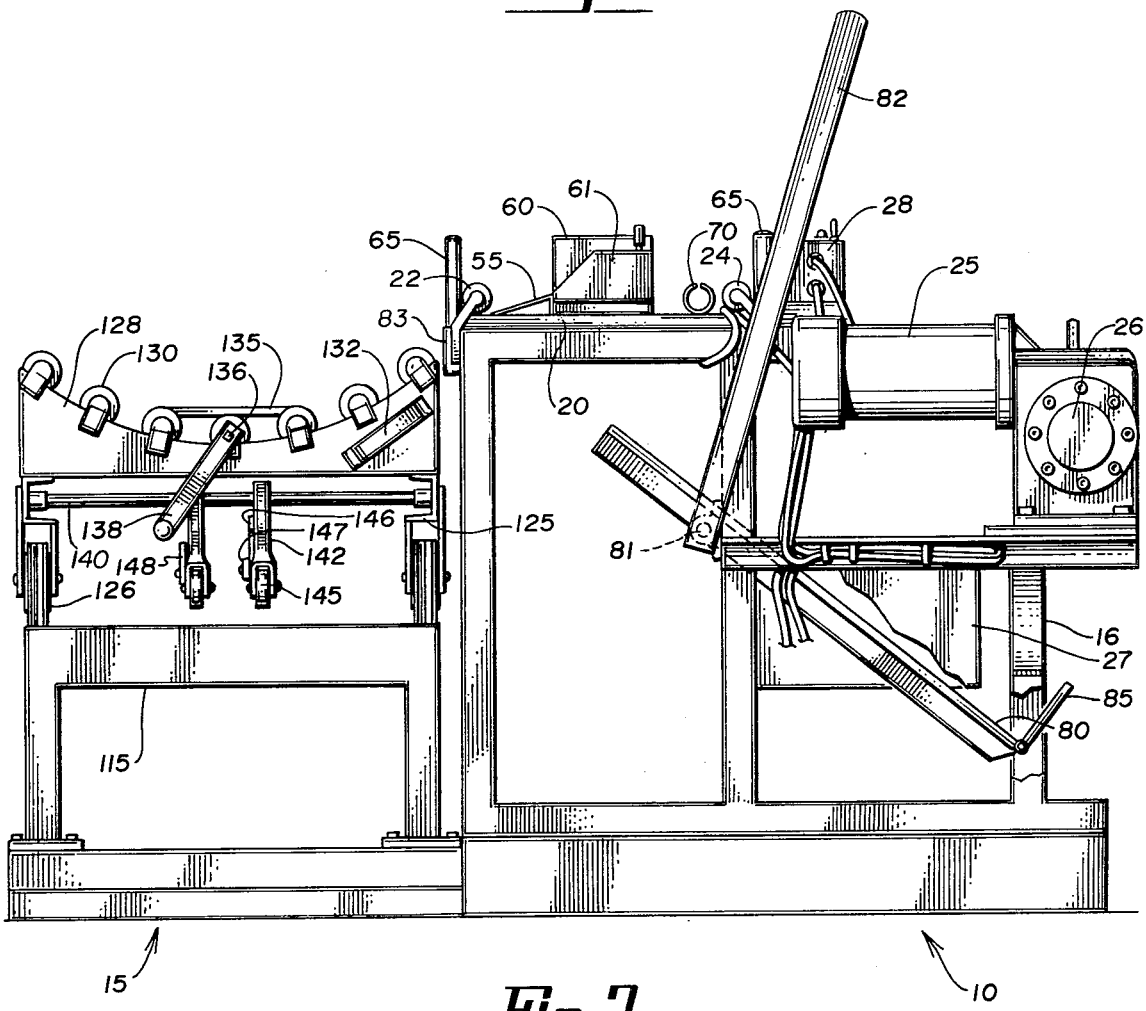
FIG. 2 is an end elevation view of the apparatus of FIG. 1.
Figure 7:
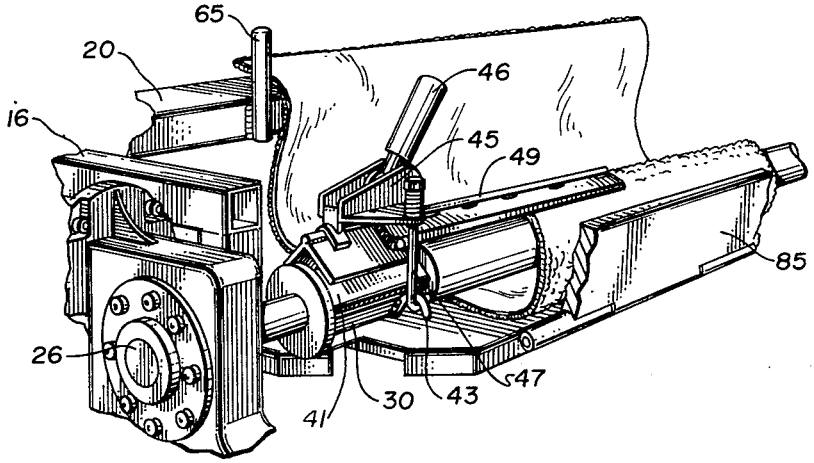
Figure 3:
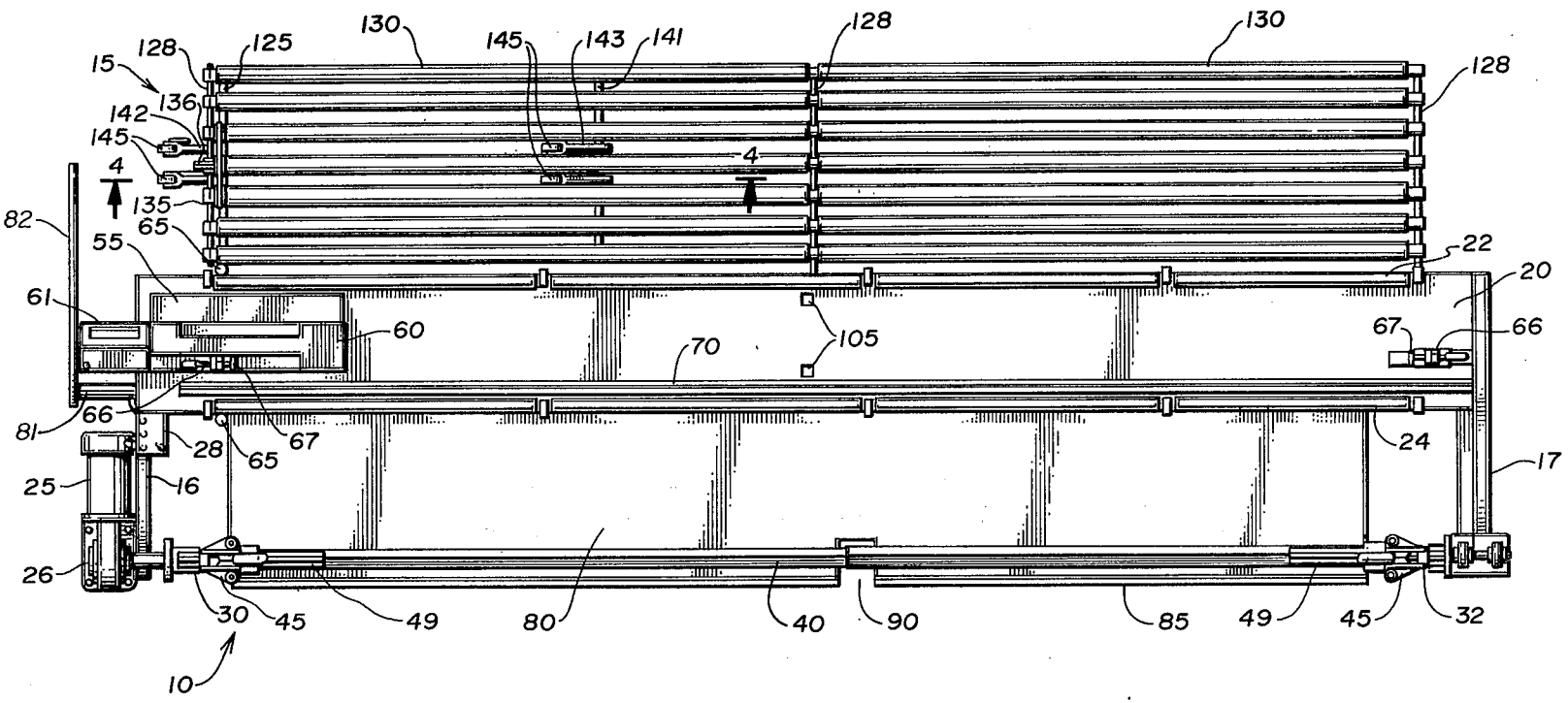
FIG. 3 is a plan view of the apparatus of FIG. 1.

The improved floor covering measuring and cutting apparatus is shown in FIGS. 1, 2, and 3 as including a measuring and cutting table 10 and a roll supporting bed 15 adjacent thereto. The measuring and cutting table 10 is comprised of a frame 18 having end supports 16 and 17 at the ends of the same with a table top 20 affixed to the top of the frame 18 connecting the end supports. The table top of the measuring and cutting table has a plurality of roller members 22 and 24 mounted on the two edges of the table top extending between the end supports and raised therefrom to support the floor covering material as it is moved about the table.

As will be seen in FIGS. 1, 2, and 3, the end supports 16 and 18 extend beyond the width of the table top 20 and to one side thereof. A drive motor 25 and power supply 27 are mounted on the end support 16 beyond the edge of the table top. The drive motor 25 has suitable gearing 26 attached thereto, and a control box 28 for controllably energizing the motor is positioned on the table top. The gear box mounted on the end of the end support 16 near the top thereof has a transversely extending drive mandrel 30 with a notched shaft receiving surface at the end of the same extending generally parallel at the edge of the table top. The end support 17 has a journaled or driven mandrel 32 mounted thereon with a similarly V-shaped shaft receiving notch at the end of the same. The mandrels 30, 32 are axially aligned and spaced from the edge of the table top. A shaft member 40 is positioned between the mandrels 30, 32. It is adapted to have the floor covering material rolled up on the same during the measuring and cutting operation. The shaft 40 has square extremities 41 to fit into the V-shaped notches of the mandrels. Shaft 40 may be made in two telescopic sections to fit the desired length of the machine, as will be hereinafter noted. The squared extremities of the shaft are held in position on the mandrels by virtue of a pair of hook members 43 that are welded to the sides of the mandrels. Suitable clamp member 45 with hooks thereon connect with the hook members 43 on the mandrels to clamp the shaft 43 therebetween. The clamp members 45 have an over center cam mounted on a lever 46 which is pivoted in the clamp member and suitably spring biased rods 47 with the hooks at the extremities fit it and connect with the hook 43 on the mandrels to secure and bias the clamp members to the mandrels to mount and secure the squared ends of the shaft therebetween. The clamp members 45 have transversely extending curved flanges 49 which project therefrom and overlie the curved portion of the shaft 40 for the purpose of clamping the floor covering material to the shaft to hold the floor covering material on the shaft as the drive mandrel is rotated to roll the carpet or floor covering thereon. The over center cam operating through its lever 46 will apply the spring bias to the rods 47 to urge the clamp member and its flange extension onto the shaft.

Control box 28 is positioned on top of the table for access thereto and suitable a floor operated switch 50 is connected by cabling through the control box to aid the operator in turning the motor on and off for driving the drive mandrel. Also positioned on top of the table is a measurement unit 60 having a suitable indicator 61 attached thereto and a opening 62 through which the floor covering material is fed for measuring purposes. A curved plate 55 is positioned on the table top adjacent to and aligned with the opening 62 in the measurement unit to aid in feeding the floor covering therethrough. Guide members 65 are positioned on top of the table. The guide members are located on each edge of the table and serve to guide the edge of the floor covering material as it moves through the measurement unit 60 and across the table top. Also included on the table top are over center clamp members 66 which are affixed to the top of the table and have a gripping member 67 which engage the floor covering material and clamp it to the table top when measurement is completed and cutting of the floor covering material is to take place. The clamp members 66 are positioned at each end of the table. The edge of the table top closest to the driving and driven mandrels also mounts a cutter guide tube 70 which extends across the extent of the table and is located adjacent the rollers 24 on this edge of the table. A suitable cutting knife (not shown) may be positioned in the guide tube and drawn across the extent of the guide tube with the floor covering material thereon to sever the same from the bulk roll as the knife is moved through the guide tube on the table top.

The measuring and cutting table 10 mounts a pivoted guide plate 80 beneath the surface of the table top 20 and on the side of the table top adjacent the drive and driven mandrels. The guide plate is pivoted on a shaft 81 which is journaled to the frame of the end supports 16 and 18. A lever arm 82 positioned off the end of the end support 16 is connected to an extension of the shaft 81 for the purpose of pivoting the shaft and the guide plate 80 which is attached thereto. The plate has a length substantially equal to the distance between the drive and driven mandrels and it is connected to the shaft 81 intermediate the width of the same such that the plate may be pivoted from a substantially vertical position to a horizontal position in which the edge of the plate will be positioned below the shaft 40 carried by the mandrels 30 and 32. The lever 82 and plate 80 may be held in this position through a latch flange 83 on the support 16 which holds the lever arm 82 in a tilted position. The edge of the guide plate 80 has pivoted flange sections 85 which are hinged to the end of the guide plate and is biased by means of springs included with the hinge to pivot from a position parallel to the extent of the guide plate 80 to a position normal thereto. Each flange section 85 will normally be biased to the normal position so that when the guide plate is pivoted to the horizontal position, it will be disposed slightly beyond the surface of the shaft 40. The flange sections 85 together with the guide plate 80 when pivoted to the horizontal position, will aid in moving floor covering material beneath the mandrel and permit the same to be rolled around the shaft for ease in starting of the wrapping of the floor covering on the shaft positioned between the driven and drive mandrels. As the roll circumference or diameter of the floor covering material on the shaft is increased, pressure of the floor covering material on the shaft 40 will urge the flange sections 85 toward the position in which it will be disposed substantially parallel to the guide plate 80. The hinged flange sections 85 are separated and a portion of the guide plate 80 adjacent the hinge has a notch 90 positioned therein, for purposes to be later noted.

Figure 6:
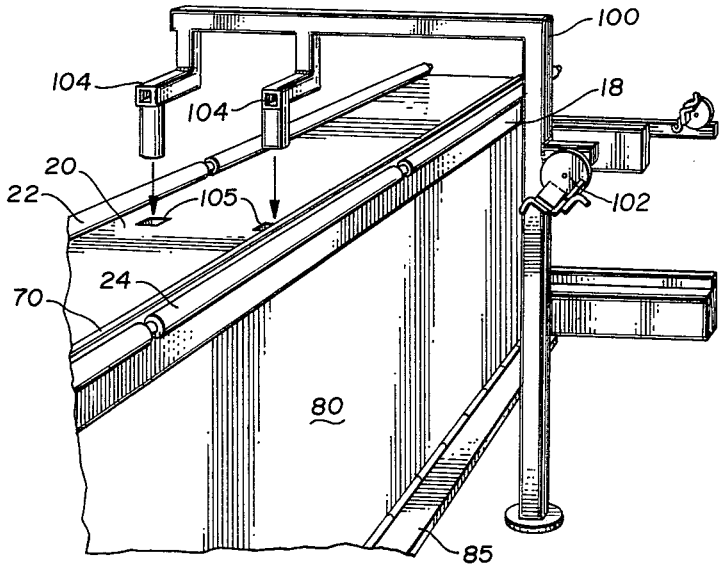
FIG. 6 is a perspective view of a leg attachment for the apparatus for adjusting the apparatus for varying width of floor covering material; and, FIG. 7 is a perspective view of the clamp for the drive mandrel of the apparatus.

The measuring and cutting table is adjustable for two standard widths of carpeting or floor covering through the use of a removable leg 100 (see FIG. 6) carrying a separate journaled mandrel 102 thereon. The removable leg 100 has a flange section 104 which extends over the top of the table top and with the extremities of the same fitting into apertures 105 of the table top to secure the same therein. This permits the adjustment of the table for varying carpet widths such as from 4 to 8 feet width with the removable leg and from 9 to 12 feet for the remainder of the table. Additional width carpeting, such as 15 feet widths, may be accommodated by adjustment of the end section in a conventional manner, such as is shown in our co-pending application referenced above. The notches 90 in the pivoted plate 80 and hinged flange section 85 align with the leg 100 so that the guide plate and flange sections may be pivoted without obstruction with the leg.

The adjustable roll holding bed 15 is positioned adjacent the measuring and cutting table and is comprised of a base frame 115 which is disposed adjacent to and in substantial contact with the frame 18 of the cutting table having approximately the same length of the table. The base frame has a pair of guide surfaces 120 on the upper edge of the same and on either side of the same which guide surfaces mount a bed frame 125, the latter having rollers 126 disposed along the edge of the same. The frame 125 through the rollers 126 is moved longitudinally along the extent of the frame 115 for positioning the bed frame 125 with respect to the measuring and cutting table. The bed frame 125 includes curved upstanding flanges 128 which mount a plurality of roller members 130 in a side by side relationship extending between the curved upstanding flanges with the roller members being journaled on the flanges 128 to define a curved concave surface to the upper portion of the bed frame 125 adapted to receive a bulk roll of floor covering material and to readily roll the same thereon. The roller members 130 are preferably mounted in the bed frame 125 in two sets with an intermediate upstanding curved flange 128 journaling the ends of the roller members of the two sets midway along the extent of the bed frame 125. A suitable handle 132 is included on the upstanding portion of the frame 125 adjacent the motor end of the measuring and cutting table such that the operator may operate the controls on the measuring and cutting table and, at the same time, longitudinally adjust the bed frame 125 on its supporting frame 115 to position the edge of the floor covering material in alignment with the guides 65 on the measuring and cutting table and through the measuring unit 60. To aid in the movement of heavy rolls of carpeting, two or three of the bottom roller members 130 have a belt 135 positioned around the same. One of the journaling shanks of one of the roller members around which the belt is positioned has a crank end 136 to which a removable crank 138 (see FIG. 2) may be attached to roll the particular roller member having the shank thereon and through friction drive with the belt 135 to roll the remaining roller members around which the belt is positioned. This aids in moving a heavy roll of carpeting in the feeding of a roll of floor covering material onto a measuring and cutting machine. It will be obvious that a suitable motive drive, such as a motor, may be used in place of the crank to move the rollers and belt and hence, the floor covering material on the bed frame.

Figure 4:
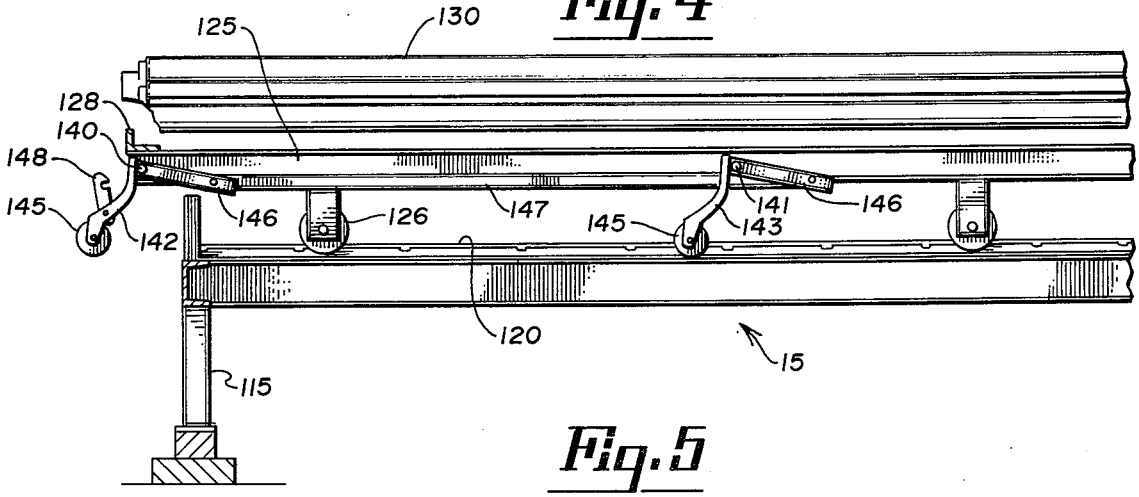
FIG. 4 is a sectional view of the apparatus of FIG. 3 taken along the lines 4—4 therein showing the adjustable bed portion of the measuring and cutting apparatus.
Figure 5:
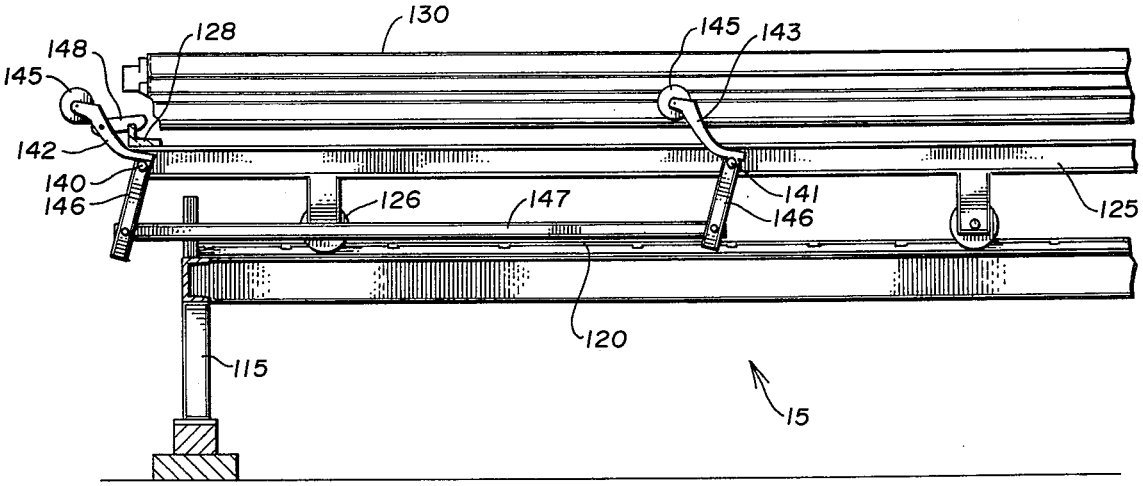
FIG. 5 is the sectional view of the adjustable bed of FIG. 4 showing the loading rollers elevated.

In addition to the roller members 130 on the bed, the bed frame 125 additionally mounts a pair of shafts 140, and 141 below the level of the concave surface defined by the rollers with the shaft 140 being located at one end of the bed frame and the shaft 141 being located intermediate along its extent. These shafts mount pairs of lever arms 142 and 143 respectively the lever arms having roller members 145 at the ends of the same. Thus, the lever arms 142 define a pair of support rollers at the end of the bed frame and the arms 143 on shaft 141 define a second pair of roller members. The levers are tied together by a linkage arms 146, 147 respectively and one of the lever arms 142 has a latch member 148 attached to the same. The operator may move the lever arms from a depending position below the curved surface of the bed (see FIG. 4) to a position in which the roller members will be above the level of the curved bed (see FIG. 5) with the rollers on the lever arms 143 being located intermediate the extent of the curved bed and elevated between the roller members 130 thereon. The arms 142 with rollers thereon will be displaced out from the end of the bed and in the elevated position maintained there through the latch member 148 which engages the upstanding flange 128 of the bed frame 125. The roller members 145 will provide a surface by means of which a roll of floor covering material may be loaded on the bed from the end of the same. Thus, an operator may tilt a roll of floor covering material onto the first set of rollers and guide the floor covering roll on the second set of rollers 145 elevated above the curved surface of the bed. By raising one of the arms and releasing the latch, the roll may be returned to the surface of the bed 125 by movement of the lever arms 142, 143 to the lowered or depending position.

In the improved apparatus, a suitable table (not shown) may be mounted next to the roll supporting bed to hold a carpet roll as desired. The carpet roll may be loaded directly on the bed frame through a conventional fork lift or may be loaded from the end of the bed through the use of the guide rollers on the levers 142, 143 in an elevated position.

In the operation of the improved measuring and cutting system, the roll of floor covering material is loaded on the bed frame and positioned thereon such that the floor covering material may be unrolled therefrom and fed across the measuring and cutting table for measuring and cutting. The belt 135 positioned around certain of the roller members 130 and the rotation of the same through a crank 138 or motor to rotate these rollers aids in unrolling the floor covering material from the bulk roll thereon. The edge of the roll of floor covering material will be aligned with the guide members 65 on the table top such that this edge may be fed through the opening 62 in the measuring unit 60. The meter 61 is adjusted so that measurement of the carpet or floor covering material to be taken from the roll will begin when the leading edge of the same is at the cutting guide 70. The indicating unit 61 will be adjusted to zero at that point and as further floor covering material is drawn through the measuring unit, it will record the amount passing over the guide. The guide plate 55 on the edge of the table and adjacent the measuring unit aids in guiding the floor covering material into the opening 62 in the measuring unit. After sufficient floor covering material is advanced through the measuring unit to extend underneath the shaft and with the guide plate 80 and flange section 85 pivoted to an elevated position below the edge of the shaft 40 and with the flange sections 85 extending around the same, the floor covering material will be directed around the shaft. At this point, the clamp members 45 with the flange extension 49 thereon will clamp the floor covering material to the shaft 40. The motor may then be operated to drive or rotate the drive mandrel, rotating the shaft on the drive and driven mandrels and causing the floor covering material to be wound around the shaft. The guide flange section 85 on the edge of the guide plate 80 will insure a proper feed along the extent of the shaft until the roll is well started. Thereafter, the operator will operate the motor until the exact amount of floor covering material is moved over the cutting guide as indicated on the measurement meter 61. At this point the motor is deenergized and the clamps 66 are clamped down on the floor covering. A suitable cutter member is then drawn through the cutter guide severing the carpeting or floor covering from the roll. Once the cutting has been complete, continued operation of the drive motor for the driving mandrel will wind up the remaining carpeting or floor covering on the shaft 40. At this point, a protective covering or paper packaging may be wound around the roll and the same sealed thereon to package the measured and cut piece for shipment. The bulk roll may then be rotated in the opposite direction through the crank to roll up on the main roll the portion of the carpeting left on the measuring and cutting table. Once the packaging has been complete, the clamp members 45 are released through operation of the over center cam and lever releasing the clamp members from the driving and driven mandrels. Continued rotation of the driven mandrel will allow the shaft with the carpet roll thereon to be dropped from the mandrel. The shaft sections may then be withdrawn from the roll and the packaged roll removed from the cutting table area.

Whenever it is desired to change the length of the effective portion of the table, for example for shorter length, the removable leg 100 may be inserted with a shorter shaft section and the operation continued in the same manner.

The improved measuring and cutting apparatus provides a system for ease in handling of floor covering material of varying types and sizes and the removal and measurement from large rolls of such material in a desired measured amount through operation by a single operator.

In considering this invention it should be remembered that the disclosure is illustrative only, and the scope of the invention should be determined by the appended claims.

What I claim is:

1. A floor covering measuring and cutting apparatus comprising: a stand having end supports with legs thereon and a flat table top extending between said supports, roller means distributed along the one edge of each side of said flat table top; drive motor means and control means therefor mounted on one of said end supports adjacent one end of said flat table top; a drive mandrel coupled to said drive motor means; a journaled mandrel mounted on the other of said end supports and aligned with said drive mandrel; a shaft removably mounted in said mandrels and extending therebetween for rotation by said drive mandrel; said shaft being positioned to one side of and below the flat table top and adapted to have floor covering material rolled thereon with operation of said drive motor means; a guide plate pivotally mounted beneath said table top on said end supports and adapted to be pivoted to be positioned below said shaft; lever means attached to said guide plate for pivoting the same; guide means positioned across said table top adjacent said one end thereof; measuring means positioned on said table top adjacent said drive means for measuring floor covering moved through said measuring means and across said table top; a cutter guide positioned on the table top adjacent the edge of said table top and adjacent said drive and driven mandrels; and an adjustable bed positioned longitudinally adjacent the extent of said stand and having a concave surface for supporting and rolling a roll of carpet material from which a piece of floor covering is to be measured and cut; said bed being adjustable longitudinally to bring an edge of the carpet material into alignment with the guide means on said table top as said roll of carpet material is unrolled.

2. The floor covering measuring and cutting apparatus of claim 1 in which the concave surface of the adjustable bed is formed of a series of rollers distributed along the curved surfaces of the same.

3. The floor covering measuring and cutting apparatus of claim 2 in which the adjustable bed is supported on a frame through rollers which permit longitudinal adjustment of the bed relative to the frame and the stand.

4. The floor covering measuring and cutting apparatus of claim 3 in which certain of said rollers on said adjustable bed have drive means coupled thereto for rotating said certain of said rollers to rotate the roll of carpet supported thereon.

5. The floor covering measuring and cutting apparatus of claim 4 in which said drive means associated with certain of said rollers includes a belt positioned over said rollers and motive means attached to one of said rollers to rotate said rollers and said belt.

6. The floor covering measuring and cutting apparatus of claim 5 in which the motive means is a hand crank projecting from the end of said bed.

7. The floor covering measuring and cutting apparatus of claim 1 in which roller means are elevated on the side of the flat table top, and a plate-like guide member is positioned on the table top from one edge to said measuring means.

8. The floor covering measuring and cutting apparatus of claim 1 in which the guide plate has a pivoted flange section opposite its pivotal mounting which is biased to a position normal to the general extent of the guide plate.

9. The floor covering measuring and cutting apparatus of claim 8 in which the flange section extends the length of the guide plate and is hinged and biased thereto being pivoted toward said shaft to bear against carpet material rolled on said shaft.

10. The floor covering measuring and cutting apparatus of claim 3 in which the adjustable bed includes a plurality of pairs of spaced roller members mounted on arms and pivoted on the frame of the bed being interconnected to pivot from a position below the concave surface of the bed to a position above said convave surface of said bed with said roller members having an axis of rotation normal the axis of rotation of the rollers forming the concave surface of the bed.

11. The floor covering measuring and cutting apparatus of claim 1 including aperture means in said table top intermediate and extent thereof, and a removable leg member having a driven mandrel journaled thereon, said leg member being adapted to be mounted in the aperture means in the table top with a shortened shaft to accommodate a narrower width of floor covering material.

12. The floor covering measuring and cutting apparatus of claim 11 in which the guide plate has a notch therein to fit around the removable leg member.

13. The floor covering and measuring apparatus of claim 9 in which the guide plate and pivoted flange section having notch therein intermediate the extent of the same.

* * * * *